United States Patent [19]

Spaans et al.

[11] 4,342,162

[45] Aug. 3, 1982

[54] DEVICE FOR PLANING A BODY OF GROUND MATERIAL

[75] Inventors: Cornelis Spaans, Delft; Herman H. Nijhof, Purmerend, both of Netherlands

[73] Assignee: B.V. Machinefabriek en Constructiewerkplaats Gebr. Klinkenberg, Wormerveer, Netherlands

[21] Appl. No.: 111,383

[22] Filed: Jan. 11, 1980

[30] Foreign Application Priority Data

Jan. 12, 1979 [NL] Netherlands ..... 7900266

[51] Int. Cl.[3] ..... E02F 3/06; E02F 5/00

[52] U.S. Cl. ..... 37/1; 37/54; 37/108 R; 198/513; 404/101

[58] Field of Search ..... 37/DIG. 8, 66, 1, 57, 37/54, 108 R, 108 A; 404/119, 118, 101, 91, 96; 198/513, 518; 406/56

[56] References Cited

U.S. PATENT DOCUMENTS

| | | | |
|---|---|---|---|
| 364,158 | 5/1887 | Bowers | 37/66 |
| 2,065,698 | 12/1936 | Heltzel | 404/101 |
| 3,015,259 | 1/1962 | Apel et al. | 404/101 |
| 3,423,859 | 1/1969 | Swisher, Jr. et al. | 37/108 R |
| 3,962,803 | 6/1976 | O'Brien | 37/66 |
| 4,037,874 | 7/1977 | Willums | 37/DIG. 8 |
| 4,040,667 | 8/1977 | Tax et al. | 37/DIG. 8 |

FOREIGN PATENT DOCUMENTS

| | | | |
|---|---|---|---|
| 619655 | 8/1978 | U.S.S.R. | 37/DIG. 8 |

*Primary Examiner*—Clifford D. Crowder

[57] ABSTRACT

A device for planing a body of ground material comprising at least one tube rotatably mounted in a supporting construction capable of being moved in horizontal position and rotated parallel to itself over the surface of the body to be planed. At least one helical blade is wound about the tube and merges into a scoop at the discharge end as regards the direction of conveyance. The scoop has the same radial dimension as the helical blade, while an opening is provided in the wall portion of the tube partially surrounded by the scoop. The tube is hollow at least at the location of the scoop and the hollow part is connected to a conveyor for discharging therefrom the quantity of ground material removed from the top surface.

7 Claims, 6 Drawing Figures

DEVICE FOR PLANING A BODY OF GROUND MATERIAL

The invention relates to a device for in particular subaqueously planing a body of ground material, particularly a gravel body.

When carrying out hydraulic engineering works sometimes it will be necessary to dig out a trench in the bottom and to fill the same again with gravel for foundation purposes, whereupon the top surface of this gravel body has to be planed with an accuracy of only some centimeters.

The object of the invention is to provide a device by means of which this accurate planing may be carried out while by means thereof the removed amount of superfluous material may be recovered again at the same time.

This object is achieved by the device according to the invention comprising at least one tube rotatably mounted by means of bearings in a supporting construction capable of being moved along a guide means in such a manner that the tube may be moved in horizontal position and rotated with the aid of driving means parallel to itself over the surface of the ground body to be planed, at least one helical blade being wound about said tube, said helical blade merging into a scoop at the discharge end as regards the direction of conveyance, said scoop projecting over the same radial distance as that over which the helical blade projects with respect to the tube, while an opening has been provided in the wall portion of the tube partially surrounded by said scoop and the tube is hollow at least at the location of said scoop and means have been provided for connecting the said hollow part of the tube to a conveyor means for discharging therefrom the quantity of ground material removed from the top surface of said ground body and introduced into said hollow part of the tube by said scoop.

In a simple embodiment of the device according to the invention there may have been provided only one tube having a single helical blade extending substantially over the entire length of the tube, the said length being such that the entire top surface of the ground body to be planed may be covered, the scoop being located close to the one end of the tube, said scoop collecting the material planed and displaced by the rotating helical blade, which material upon further rotation of the scoop will drop into the tube through the opening in the wall of the tube and will be finally removed therefrom with the aid of the conveyor means. When operating this device the supporting construction will thereby by loaded in only one direction.

In order to prevent the latter situation from occurring the tube may be provided with two successive helical blades having an opposite pitch, both said helical blades merging into a scoop at the discharge ends thereof while the discharge ends of the helical blades are located either next to each other or at the opposite ends.

Likewise it is possible to provide two essentially successive tubes, the discharge end of the helical blades of which are directed in opposite directions wherein for preventing the creation of projecting ridges on the surface of the material to be planed between the two tubes the helical blades overlap each other at the entrance ends directed towards each other, this being achieved by lateral displacement of one of said tubes parallel to the other one, while the outer edges of these helical blades lie in the same lower plane parallel to the axes of the tubes.

For planing surfaces having a very substantial width it is appropriate that at one side or on either side of the tube provided with said helical blades having an opposite pitch or between the two essentially successive tubes, there has been provided at least one further tube provided with only one helical blade wound about said tube while all successively arranged tubes have been displaced parallel to each other and laterally with respect to each other and the helical blades overlap each other at the entrance ends of the tube directed towards each other and the discharge end of the further tubes and the outer edges of all said helical blades lie in the same lower plane parallel to the axes of all said tubes.

One or more of said further tubes may be replaced by a scraping device the scraping means of which have extremities lying in the said lower plane.

By way of exemple an embodiment of the device according to the invention will now be described in further detail with reference to the annexed drawings in which.

Figure 1:
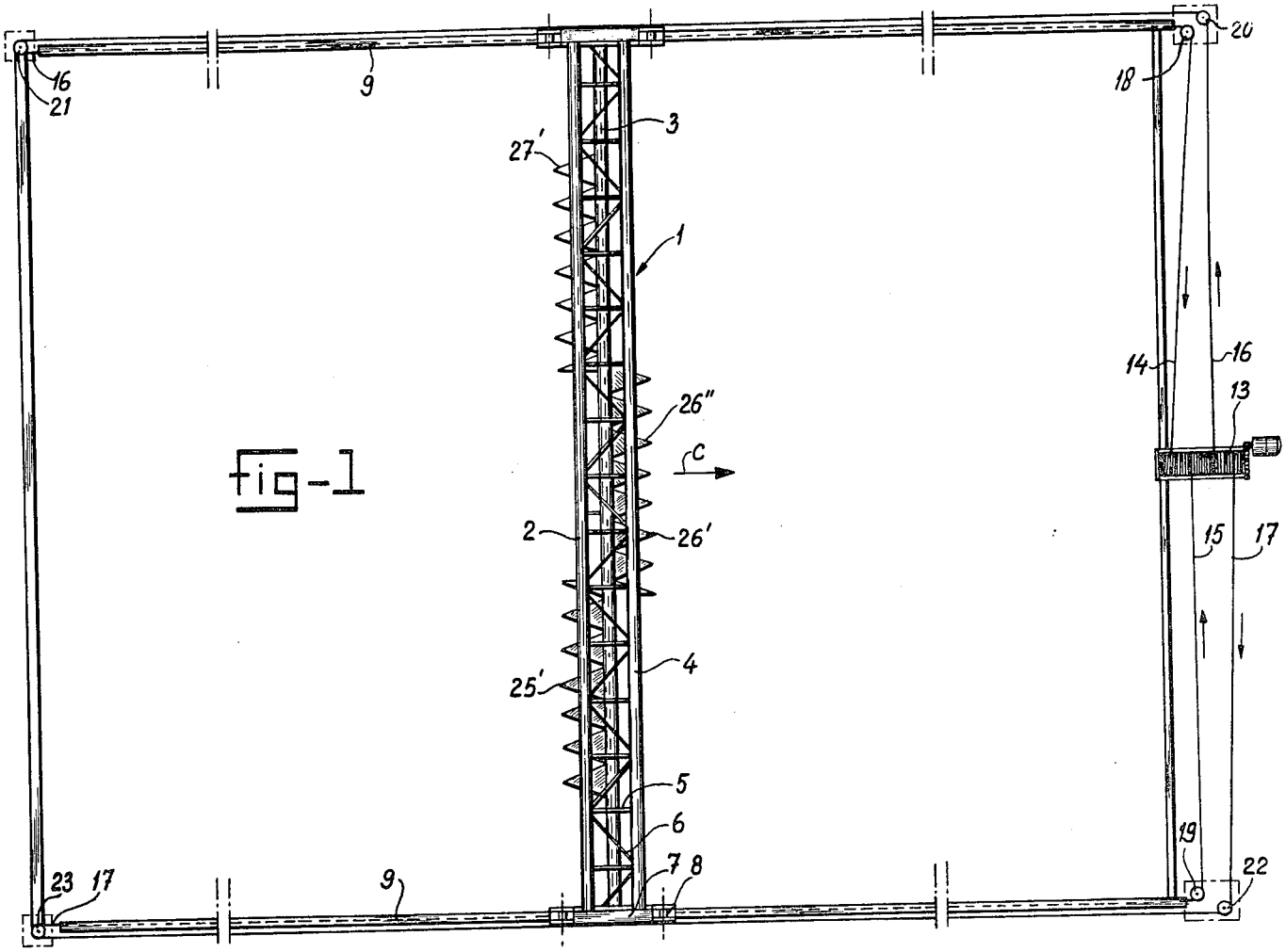
FIG. 1 shows a plan view of a device according to the invention.

FIGS. 3*a* to 3*d* show diagrammatically side elevations of alternative devices according to the present invention.

As will be apparent from the figures the device comprises a supporting construction in the shape of a girder 1 composed of three tubes 2, 3, 4 joined together into a triangular structure by means of struts 5 and cross bracings 6. On either end the girder 1 has been provided with a travelling wheel stand 7 in which the travelling wheels 8 are supported by means of bearings. The travelling wheels 8 may run over the guides 9 which guides 9 have been mounted on blocks 10 resting on the bottom 12 below the water level on either side of the gravel body 11 to be planed.

The girder 1 may be moved backward and forward parallel to itself along the guides 9 by means of a winch driving gear 13 and the pairs of traction cables 14, 15 and 16, 17 wound about the cable drum of the winch driving gear and connected to both sides of the wheel stands 7, that is the sides turned to and turned away from the winch driving gear, respectively. The cable pairs 14, 15 are guided over the discs 18 and 19 and the cable pairs 16, 17 over the discs 20, 21 and 22, 23.

Three pairs of bearings 24 have been fastened to the girder 1 in which bearings three tubes 25, 26 and 27, respectively, are rotatably supported each one thereof being in driving connection with a motor, for instance an electric motor 28 so that each of the tubes 25, 26, 27 may be rotated. About the tubes 25 and 27 there has been wound a helical blade 25' and 27' merging into a scoop 29 and 30, respectively, at the discharge end as regards the direction of conveyance indicated by the arrows A and B, respectively, which scoops project over the same radial distance at that over which the helical blade project with respect to the tube. In the wall portion of the tubes 25 and 27 partially surrounded by said scoops 29 and 30, respectively, there has been provided an opening 31 and 32, respectively, said tubes 25 and 27 being hollow at least at the location of the scoops 29 and 30. The tubes 25 and 27 have been connected to a suction tube 35 and 36, respectively, by means of rotatable couplings 33 and 34, respectively.

About the center tube 26 there have been wound two successive helical blades 26' and 26'' having an opposite pitch while the tube 26 has been staggered laterally parallel to the tubes 25 and 27 so that the helical blade 26' partially overlaps the helical blade 25' and the helical blade 26'' partially overlaps the helical blade 27'.

When the device is in operation the tubes 25, 26 and 27 are rotated and the girder is moved for instance in a direction indicated by the arrow C. Due to the rotation of the tubes 25, 26, 27 superfluous material of the top surface of the gravel body 11 to be planed will be displaced in the direction indicated by the arrows A and B by means of the helical blades wound about said tubes so that at the end of the trajectory in the direction indicated by arrow C of the girder 1 the top surface of the gravel body 11 will finally be accurately planed. The superfluous material will thereby be collected by the scoops 29 and 30, respectively, and be introduced through the openings 31 and 32, respectively, into the tubes 25 and 27 from which the material will be conveyed further by means of the suction lines 35 and 36.

Figure 2:
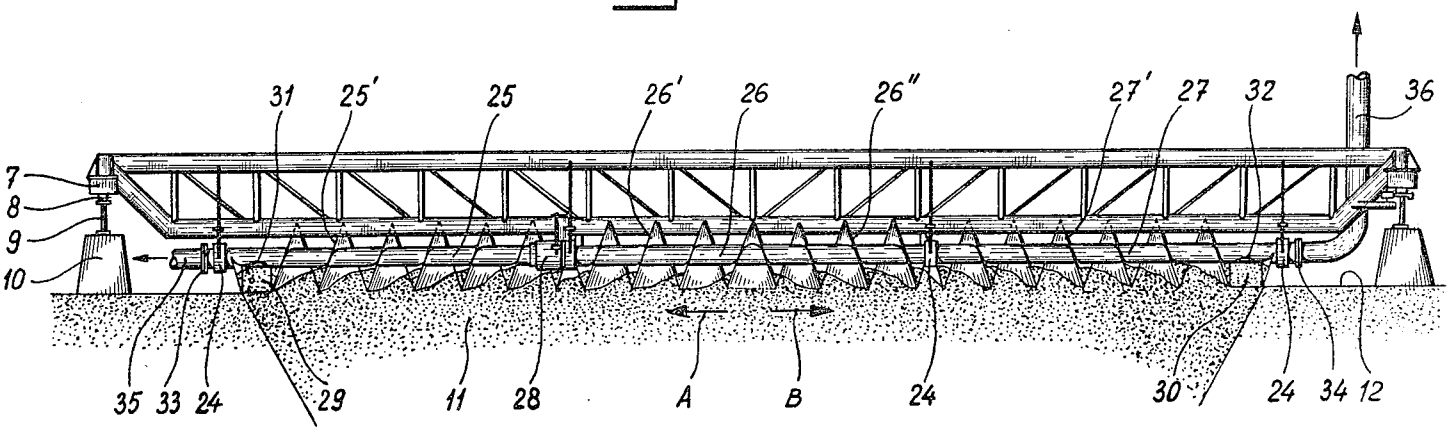
FIG. 2 shows a side elevation of this device.
Figure 3A:
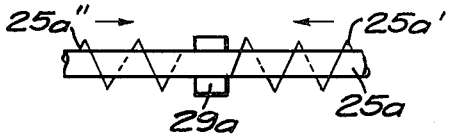
Figure 3B:
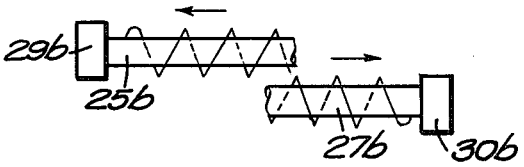
Figure 3C:
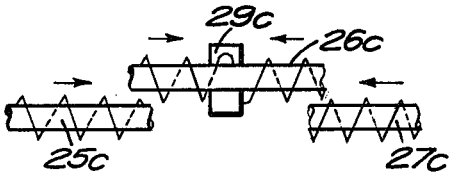
Figure 3D:
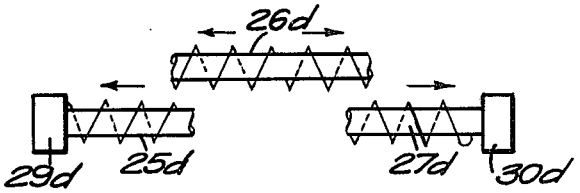

FIGS. 3*a* to 3*d* show alternative embodiments of tubes with helical blades when compared to the arrangement shown in FIGS. 1 and 2.

More specifically, (FIG. 3*a*) the tube 25 has two successive helical blades 25*a'* and 25*a''* having an opposite pitch, both helical blades merging into a scoop 29*a* at the discharge ends thereof while the discharge ends of the helical blades are located next to each other.

Likewise it is possible (FIG. 3*b*) to provide two essentially successive tubes 25*b*, and 27*b*, the discharge ends of the helical blades of which are directed in opposite directions, wherein for preventing the creation of projecting ridges on the surface of the material to be planed between the two tubes, the helical blades overlap each other at the entrance ends directed towards each other, this being achieved by lateral displacement of one of said tubes parallel to the other one, while the outer edges of these helical blades lie in the same lower plane parallel to the axes of the tubes.

For planing surfaces having a very substantial width it is appropriate that at one side or on either side (FIG. 3*c*) of the tube (26*c*) provided with said helical blades having an opposite pitch or between the two essentially successive tubes (25*d*, 27*d* in FIG. 3*d*) there has been provided at least one further tube (26*c* or 26*d* respectively) provided with only one helical blade wound about said tube, while all successively arranged tubes have been displaced parallel to each other and laterally with respect to each other, and the helical blades overlap each other at the entrance ends of the tube directed towards each other and the discharge end of the further tubes and the outer edges of all said helical blades lie in the same lower plane parallel to the axes of all said tubes.

I claim:

1. A device for planing a body of ground material comprising: at least one tube rotatably mounted in a supporting construction capable of being moved along guide means in such a manner that the tube may be moved in horizontal position and rotated with the aid of driving means parallel to itself over the surface of the body of ground material to be planed, at least one helical blade being wound about said tube, said helical blade merging into a scoop at the discharge end thereof as regards the direction of conveyance, said scoop having the same radial dimension as the helical blade projecting with respect to the tube, an opening being provided in the wall portion of the tube partially surrounded by said scoop, and the tube being hollow at least at the location of said scoop, and means for connecting said hollow part of the tube to conveyor means for discharging therefrom the ground material removed from the top surface of said body of ground material and introduced into said hollow part of the tube by said scoop.

2. The device of claim 1 wherein the tube has two successive helical blades having an opposite pitch with respect to each other, each of said helical blades merging into a scoop at the discharge end thereof.

3. The device of claim 2 wherein the discharge ends of the helical blades are located next to each other.

4. The device of claim 2, wherein at one side or the tube provided with said helical blades having an opposite pitch there is provided at least one further tube with only one helical blade wound about said further tube, said at least one further tube being displaced parallel to and laterally with respect to said tube, and the helical blades overlap each other at the entrance ends of the tubes directed towards each other, and the discharge ends of the at least one further tube and the outer edges of all said helical blades lying in the same lower plane parallel to the axes of said tubes.

5. The device of claim 2, wherein on either side of the tube provided with said helical blades having an opposite pitch there is provided at least one further tube each with only one helical blade wound about each said further tube, each of said at least one further tube being displaced parallel to and laterally with respect to said tube, and the helical blades overlap each other at the entrance ends of the tubes directed towards each other, and the discharge ends of the further tubes and the outer edges of all said helical blades lying in the same lower plane parallel to the axes of all said tubes.

6. The device of claim 1 comprising two essentially successive tubes, the discharge ends of the helical blades of which are directed in opposite direction, one of said tubes being laterally displaced parallel to the other one and the helical blades overlapping each other at the entrance ends directed towards each other while the outer edges of the helical blades lie in the same lower plane parallel to the axes of the tubes.

7. The device according to claim 1, comprising two essentially successive tubes with helical blades, at least one further tube with only one helical blade wound about said further tube, said at least one further tube being displaced parallel to and laterally with respect to said two tubes, and the helical blades overlap each other at the entrance ends of the tubes directed towards each other, and the discharge ends of the further tubes and the outer edges of all said helical blades lying in the same lower plane parallel to the axes of all said tubes.

* * * * *